US010906090B2

(12) United States Patent
Suzuki

(10) Patent No.: US 10,906,090 B2
(45) Date of Patent: Feb. 2, 2021

(54) METHOD OF PRODUCING INSERT DIE OF CASTING APPARATUS FOR MANUFACTURING CAST PRODUCT FROM MOLTEN METAL, AND CASTING APPARATUS

(71) Applicant: Suzukiseiki Corporation, Aichi-ken (JP)

(72) Inventor: Kikuo Suzuki, Aichi-ken (JP)

(73) Assignee: Suzukiseiki Corporation, Aichi-ken (JP)

( * ) Notice: Subject to any disclaimer, the term of this patent is extended or adjusted under 35 U.S.C. 154(b) by 286 days.

(21) Appl. No.: 16/171,716

(22) Filed: Oct. 26, 2018

(65) Prior Publication Data

US 2019/0060981 A1 Feb. 28, 2019

Related U.S. Application Data

(63) Continuation of application No. 14/854,438, filed on Sep. 15, 2015, now abandoned.

(30) Foreign Application Priority Data

Oct. 14, 2014 (JP) ..... 2014-210324

(51) Int. Cl.

| | |
|---|---|
| ***B22C 9/00*** | (2006.01) |
| ***B22C 23/02*** | (2006.01) |
| ***B22D 17/22*** | (2006.01) |
| ***B22C 9/06*** | (2006.01) |
| *B22D 30/00* | (2006.01) |

(52) U.S. Cl.

CPC ..... *B22C 9/00* (2013.01); *B22C 9/065* (2013.01); *B22C 23/02* (2013.01); *B22D 17/2218* (2013.01); *B22D 30/00* (2013.01)

(58) Field of Classification Search

CPC ..... B22C 9/00; B22C 9/065; B22C 23/02; B22D 17/2218; B22D 30/00

See application file for complete search history.

(56) References Cited

FOREIGN PATENT DOCUMENTS

| | | | |
|---|---|---|---|
| JP | H08-108259 | A | 4/1996 |
| JP | H09-277009 | A | 10/1997 |
| JP | 2006-326635 | A | 12/2006 |

OTHER PUBLICATIONS

Office Action issued in Japanese Patent Application No. 2014-210324, dated Aug. 7, 2018, with English Translation (11 Pages).

*Primary Examiner* — Kevin P Kerns
*Assistant Examiner* — Steven S Ha
(74) *Attorney, Agent, or Firm* — Nakanishi IP Associates, LLC

(57) ABSTRACT

A casting apparatus for manufacturing a cast product from molten metal includes a molten metal and a cooling portion. The molten metal contacts a surface for contact with the molten metal. The cooling portion forms a cooling flow passage. The cooling flow passage is configured to cool the molten metal contacting surface. At least a part of an inner surface of the cooling flow passage is constituted of a welding portion formed by welding, the welding portion sealing the cooling flow passage. The welding portion is constituted such that an exposure to the molten metal becomes equal to or less than a predetermined ratio with respect to an area of the welding portion constituting the inner surface of the cooling flow passage.

7 Claims, 14 Drawing Sheets

FIRST EMBODIMENT

FIRST EMBODIMENT

SECOND EMBODIMENT

METHOD OF PRODUCING INSERT DIE OF CASTING APPARATUS FOR MANUFACTURING CAST PRODUCT FROM MOLTEN METAL, AND CASTING APPARATUS

CROSS-REFERENCE TO RELATED APPLICATIONS

This application is a continuation application of U.S. patent application Ser. No. 14/854,438 filed on Sep. 15, 2015, which claims priority from Japanese Patent Application No. 2014-210324 filed with the Japan Patent Office on Oct. 14, 2014, the entire contents of which are i-s-hereby incorporated by reference.

BACKGROUND

1. Technical Field

The present invention relates to a casting apparatus, such as a mold and a sprue bushing, used for die-cast casting or a similar casting and a method for manufacturing the casting apparatus. More specifically, the present invention relates to the casting apparatus that internally includes cooling flow passages for cooling the casting apparatus and the method for manufacturing the casting apparatus.

2. Related Art

Conventionally, build-up welding has been performed to repair molds, and there has been proposed an improvement of the method (for example, Japanese Unexamined Patent Application Publication No. 2011-115807). In manufacturing the molds as well, to expand a freedom of design for forming a flow passage, the manufacturing method using the build-up welding has been proposed (for example, Japanese Unexamined Patent Application Publication No. 2004-34133, Japanese Unexamined Patent Application Publication No. H05-309468, and Japanese Unexamined Patent Application Publication No. 2005-52892). Meanwhile, a spread of water-soluble mold release agent for die-casting or a similar agent allows rapidly cooling the molds. While shortening of a manufacturing cycle is achieved, a problem of a heat check and a crack is likely to occur. Furthermore, it has been known as technical common knowledge that the welding repair is one cause of reduction in mold life ("Measures For Service Life Of Mold For Die-Casting", written by Masahiko Hihara, published by NIKKAN KOGYO SHIMBUN, LTD., Feb. 28, 2003, p. 289). The introduction of a cooling flow passage has been proposed also for the casting apparatus other than the mold such as the sprue bushing (Japanese Unexamined Patent Application Publication No. 2003-10953).

However, while a welding process is suitable for manufacturing the cooling flow passage, which is required to feature air tightness, from the aspect of durability of the casting apparatus, sufficient examination has been required to the welding process.

SUMMARY

One or more embodiments provide a casting apparatus manufactured using the welding process for manufacturing the cooling flow passages while minimizing deterioration of durability of the casting apparatus and a method for manufacturing the casting apparatus.

One or more embodiments of the present invention provides a casting apparatus for manufacturing cast products from molten metal. The casting apparatus includes a molten metal contacting surface and a cooling portion. The molten metal contacting surface is in contact with the molten metal. The cooling portion forms a cooling flow passage. The cooling flow passage is configured to cool the molten metal contacting surface. At least a part of an inner surface of the cooling flow passage is constituted of a welding portion formed by welding. The welding portion seals the cooling flow passage. The welding portion is constituted such that an exposure to the molten metal becomes equal to or less than a predetermined ratio with respect to an area of the welding portion constituting the inner surface of the cooling flow passage.

With the casting apparatus of one or more embodiments according to the present invention, at least a part of the inner surface of the cooling flow passage is constituted of the welding portion formed by welding. This allows minimizing excessive temperature rise by casting and also allows minimizing rapid temperature fall by cooling with a mold release agent. Meanwhile, the welding portion is constituted such that the exposure to the molten metal becomes equal to or less than the predetermined ratio with respect to the area of the welding portion constituting the inner surface of the cooling flow passage. This allows minimizing an influence of fatigue degradation caused by a temperature cycle by sufficient cooling. Consequently, the reduction in durability of the casting apparatus caused by the welding process can be minimized. The predetermined ratio can be set appropriately depending on the operating state and the design of the casting apparatus.

DETAILED DESCRIPTION

The following describes respective embodiments of the present invention in the following order. It will be understood that the scope of the present invention is not limited to the described embodiments, unless otherwise stated.

A. Constitution of Casting Apparatus (Mold) in First Embodiment:

B. Method for Using Mold in First Embodiment:

C. Method for Manufacturing Mold in First Embodiment:

D. Constitution of Casting Apparatus (Spool Bush) in Second Embodiment:

E. Method for Manufacturing Spool Bush in Second Embodiment:

F. Constitution of Casting Apparatus (Mold) in Third Embodiment:

G. Method for Manufacturing Mold in Third Embodiment:

H. Modification:

A. Constitution of Casting Apparatus (Mold) in First Embodiment

Figure 1:
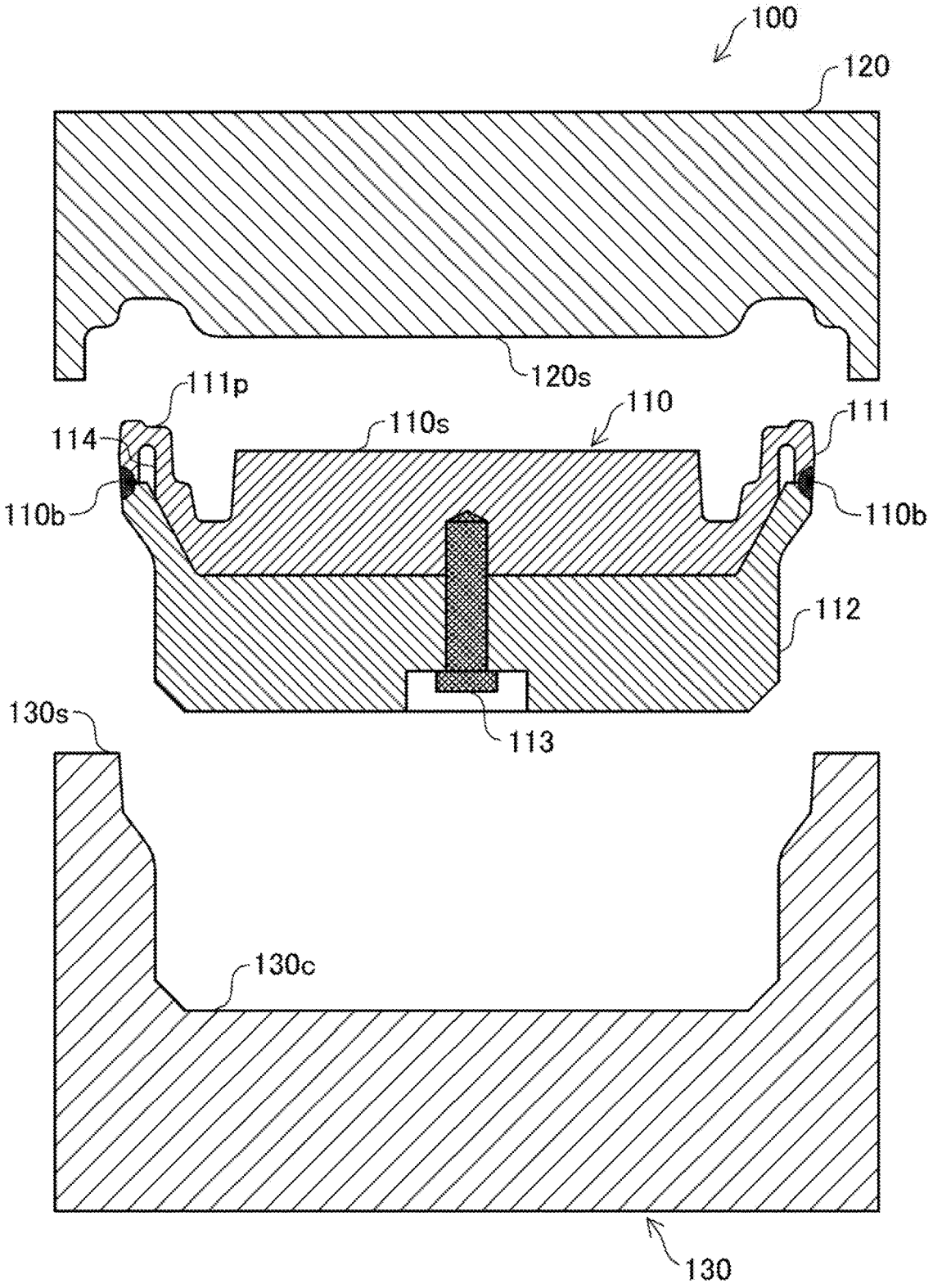
FIG. 1 is a cross-sectional view illustrating a constitution of a mold 100 according to a first embodiment of the present invention.

FIG. 1 is a cross-sectional view illustrating a constitution of a mold 100 according to a first embodiment of the present invention. The mold 100 includes an insert die 110, a fixed-side main mold 120, and a movable-side main mold 130. The insert die 110 has a product shape forming surface 110*s*, which forms the shape of a cast product. The fixed-side main mold 120 has a product shape forming surface 120*s*. The movable-side main mold 130 has a product shape forming surface 130*s* and a depressed portion 130*c*. The three product shape forming surfaces 110*s*, 120*s*, and 130*s* can form an enclosed space for casting cast products in a mold-set-up state, which will be described later. This enclosed space will be described later. The mold 100 is the casting apparatus used for casting.

The insert die 110 includes a first part 111, a second part 112, and a bolt 113. The first part 111 has the product shape forming surface 110*s*. The second part 112 has an outer surface fitted to the depressed portion 130*c* of the movable-side main mold 130. The bolt 113 permanently fastens the first part 111 and the second part 112. In this embodiment, when viewed from the axial direction of the bolt 113, all the three product shape forming surfaces 110*s*, 120*s*, and 130*s* have a circular shape around its axial center. The product shape forming surfaces 110*s*, 120*s*, and 130*s* are also referred to as molten metal contacting surfaces.

The product shape forming surface 110*s* of the insert die 110 has protrusions 111*p*. The protrusion 111*p* is a shaping part disposed upon request of outer specification of cast products. Focusing on the shape of the protrusion 111*p*, the protrusion 111*p* has a property of likely to be a high temperature during a molten metal pouring process and likely to be rapidly cooled during cooling. This is because that while the protrusion 111*p* is surrounded by molten metal and cooling water, a heat conduction path to the movable-side main mold 130 is narrow.

The insert die 110 includes cooling water passages 114 (which corresponds to a cooling portion in the appended claims) to reduce the above-described temperature change. The cooling water passage 114 has an annular, circulating shape viewed from the axial direction of the bolt 113. The cooling water passage 114 communicates with a cooling water inlet and a cooling water discharge port (not illustrated). The cooling water passages 114 are formed by covering openings of the annular depressed portions, which are formed at the first part 111, with the second part 112. The cooling water passage 114 is sealed from the outside of the cooling water passage 114 with a weld bead 110*b* (also referred to as a welding portion or a weld-overlay portion), which joins the first part 111 and the second part 112.

The fixed-side main mold 120, the movable-side main mold 130, the first part 111, and the second part 112 are all made of an SKD 61 and/or other tool steels. The weld bead 110*b* is a part over which deposited metal with a composition similar to the SKD 61 is overlaid. This build-up welding is formed by TIG welding using a TIG welding rod (for example, DS-61G). The combination of a plurality of components forms the movable-side main mold 130 and the insert die 110, thus constituting one side of the mold 100.

The entire outer surface of the weld bead 110*b* is in contact with the inner surface of the depressed portion 130*c* of the movable-side main mold 130. Thus, the mold 100 is constituted such that the weld bead 110*b* is not to be exposed to the molten metal. Since the weld bead 110*b* is not exposed to the molten metal, this allows preventing a heat cycle caused by the contact of the weld bead 110*b* with the molten metal. Furthermore, the entire outer surface of the weld bead 110*b* is in contact with the movable-side main mold 130, this allows exchanging heat remarkably effective between the outer surface and the movable-side main mold 130. Accordingly, partial excessive temperature change only at the outer surface of the weld bead 110*b* can be minimized. This allows minimizing a heat check and a crack.

B. Method for Using Mold in First Embodiment

Figure 2:
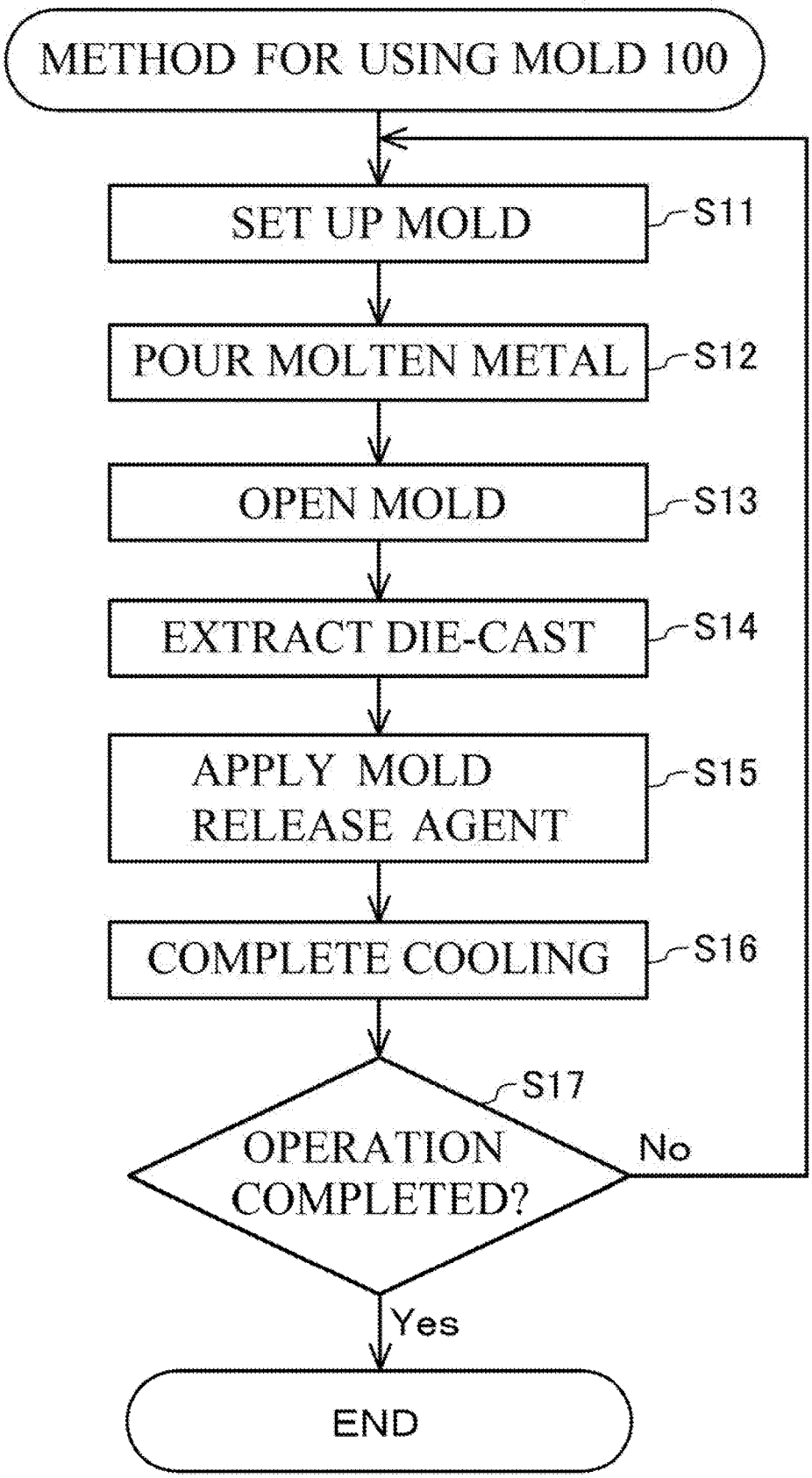
FIG. 2 is a flowchart illustrating a method for using the mold 100 according to the first embodiment.
Figure 3A:
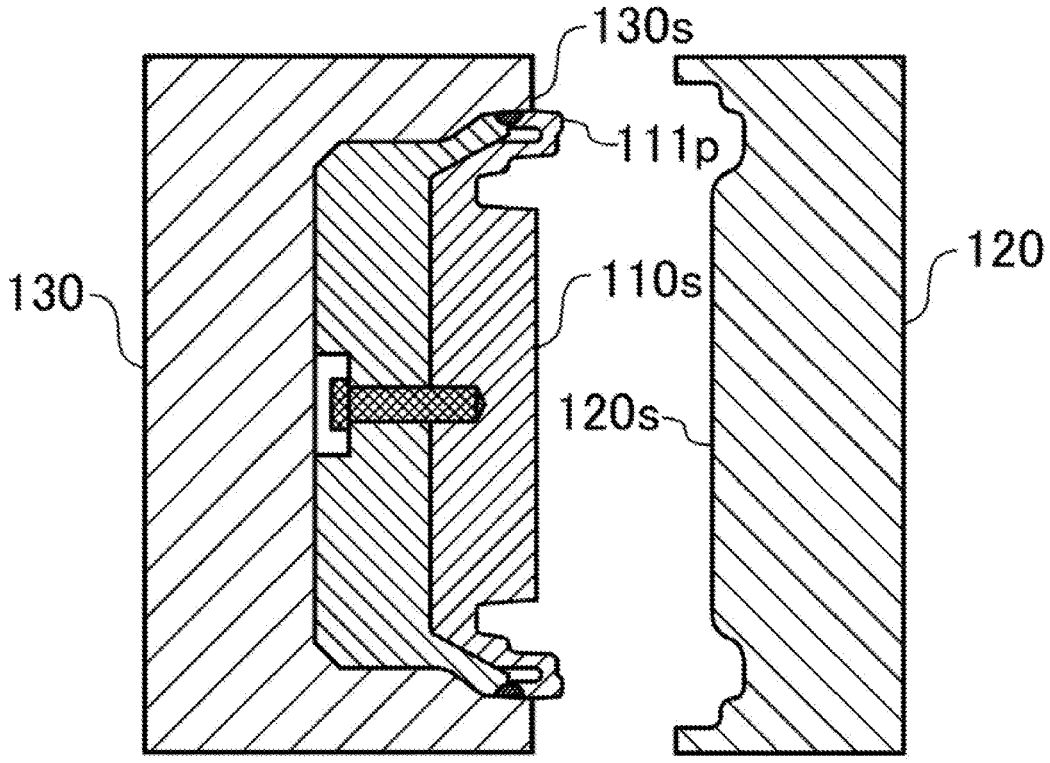
FIG. 3A is a process drawing illustrating the method for using the mold 100 according to the first embodiment.
Figure 3B:
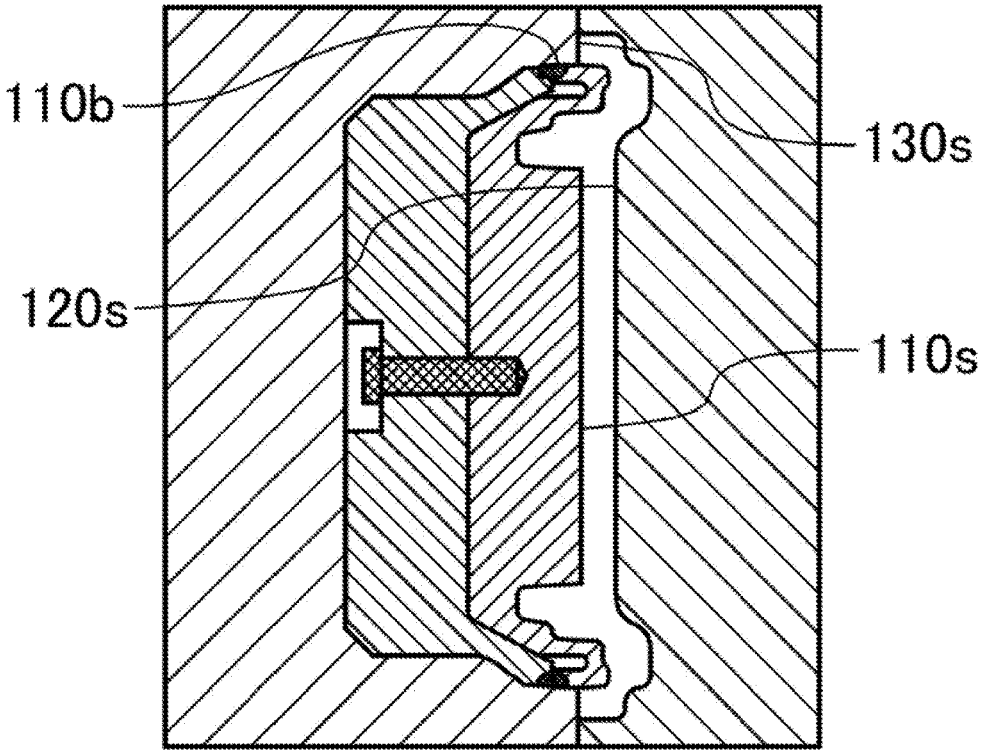
FIG. 3B is a process drawing illustrating the method for using the mold 100 according to the first embodiment.
Figure 3C:
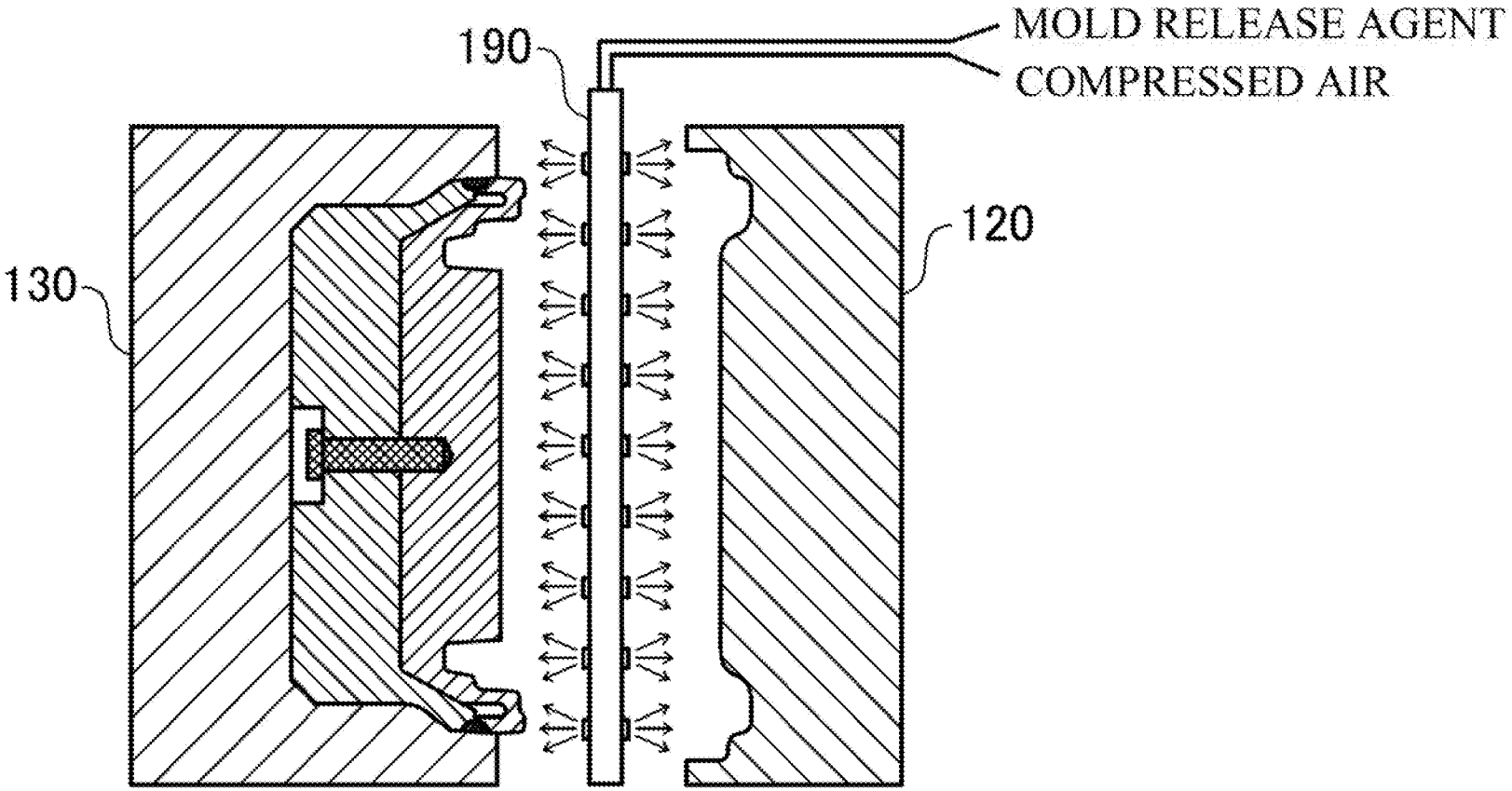
FIG. 3C is a process drawing illustrating the method for using the mold 100 according to the first embodiment.

FIG. 2 is a flowchart illustrating a method for using the mold 100 according to the first embodiment. FIG. 3A to FIG. 3C are process drawings illustrating the method for using the mold 100 according to the first embodiment. To produce cast products, the mold 100 is used in the following method.

Step S11 performs a mold-setting-up process. The mold-setting-up process forms a mold with the fixed-side main mold 120 and the movable-side main mold 130 from which the cast product has been taken out and where the cooling has been completed (see FIG. 3A). The mold-setting-up process moves the movable-side main mold 130 having the insert die 110, and forms the enclosed space (see FIG. 3B). The enclosed space is to cast the cast products with the three product shape forming surfaces 110*s*, 120*s*, and 130*s*, which are provided to the fixed-side main mold 120, the insert die 110, and the movable-side main mold 130, respectively.

Step S12 performs the molten metal pouring process. The molten metal pouring process press-fits a high-temperature molten metal to the mold. As the molten metal, for example, an aluminum alloy is used. This heightens the temperatures of all the product shape forming surfaces 110*s*, 120*s*, and 130*s*. Meanwhile, the molten metal hardens and an aluminum die-cast product (not illustrated) is casted. After completion of solidification, the process proceeds to the next process.

Step S13 performs a mold opening process. The mold opening process moves the movable-side main mold 130 to separate the movable-side main mold 130 from the fixed-side main mold 120 to allow extraction of the aluminum die-cast product (not illustrated). Step S14 extracts the aluminum die-cast product. Then, the manufacturing process for aluminum die-cast products with the mold 100 is completed. The manufacturing process for aluminum die-cast products proceeds to the next process, which does not use the mold 100.

Step S15 applies a mold release agent to the insert die 110, the fixed-side main mold 120, and the movable-side main mold 130 with a spray device 190 (see FIG. 3C). This embodiment uses a water-soluble mold release agent for die-casting (for example, TX-2400 and GL-3700) as the mold release agent. The mold release agent is applied by spraying the water-soluble mold release agent for die-casting to the product shape forming surfaces 110*s*, 120*s*, and 130*s* (see FIG. 3C). After completion of the cooling (Step S16), in the case where the aluminum die-cast product is not an end product, the process can be returned to the mold-setting-up process (Step S10) (Step S17). In the case where the aluminum die-cast product is the end product, the process is terminated.

The water-soluble mold release agent for die-casting forms mold-releasing films over the product shape forming surfaces 110*s*, 120*s*, and 130*s*. Meanwhile, evaporation of the water vapor allows the product shape forming surfaces 110*s*, 120*s*, and 130*s* to be rapidly cooled. This allows achieving the short cycle time of the casting process.

The rapid cooling of the product shape forming surfaces 110*s*, 120*s*, and 130*s* increases the problem of thermal fatigue, causing the heat check and the crack. Specifically, according to the knowledge of the inventor of this application, in a process where the product shape forming surfaces 110*s*, 120*s*, and 130*s* whose temperatures become high by the molten metal pouring process are rapidly cooled and contracted by the evaporation of the water vapor of the water-soluble mold release agent for die-casting, the heat check and the crack occur. This is because that the rapid contraction of the surface generates a thermal expansion difference between the surface part and the inner part, resulting in a strain.

In this embodiment, focusing on its shape, especially the protrusion 111*p* provided with the product shape forming surface 110*s*, has a property likely to be a high temperature during the molten metal pouring process. This is because that while the protrusion 111*p* is surrounded by the molten metal, the heat conduction path to the movable-side main mold 130 is narrow. However, in this embodiment, since the cooling water passages 114 are formed at the inside of the protrusions 111*p*, this allows minimizing the excessively high temperature of the protrusions 111*p*. Furthermore, while the process continues from the molten metal pouring process (Step S12) to the mold opening process (Step S13) and then proceeds to the application of the mold release agent (Step S15), the protrusion 111*p* can also be cooled with the cooling water passage 114. This allows effectively minimizing the heat check and the crack, which are caused by the cooling by the application of the mold release agent.

In this embodiment, the cooling water passages 114 are sealed by the weld beads 110*b*. With general technical common knowledge, it is considered that a mold life of a part of a die-casting mold where the welding repair has been performed is remarkably reduced compared with a non-welded portion (for example, Measures For Service Life Of Mold For Die-Casting, written by Masahiko Hihara, NIKKAN KOGYO SHIMBUN, LTD.). However, in this embodiment, it is less likely that the weld bead 110*b* causes the reduction in mold life at least due to the following reasons. The other reasons will be described later.

(1) Since the weld bead 110*b* seals the cooling water passage 114, the weld bead 110*b* is not in an excessively high temperature state.

(2) The weld bead 110*b* does not form the product shape forming surface 110*s* (not exposed to the enclosed space (see FIG. 3B), which is to cast the cast product). Accordingly, the weld bead 110*b* does not become a high temperature excessively and is not exposed under a rapid temperature decrease, which is caused by application of the mold release agent.

(3) The weld bead 110*b* is in contact with the movable-side main mold 130. Accordingly, the weld bead 110*b* and the movable-side main mold 130 do not form a thermal boundary and do not generate excessively large heat gradient.

Accordingly, the mold 100 having the constitution of the first embodiment uses the welding process for manufacturing a cooling flow passage 140 while minimizing the deterioration of durability of the mold 100. This achieves the appropriate cooling flow passage, ensuring achieving the mold 100 having long life.

C. Method for Manufacturing Mold in First Embodiment

Figure 4:
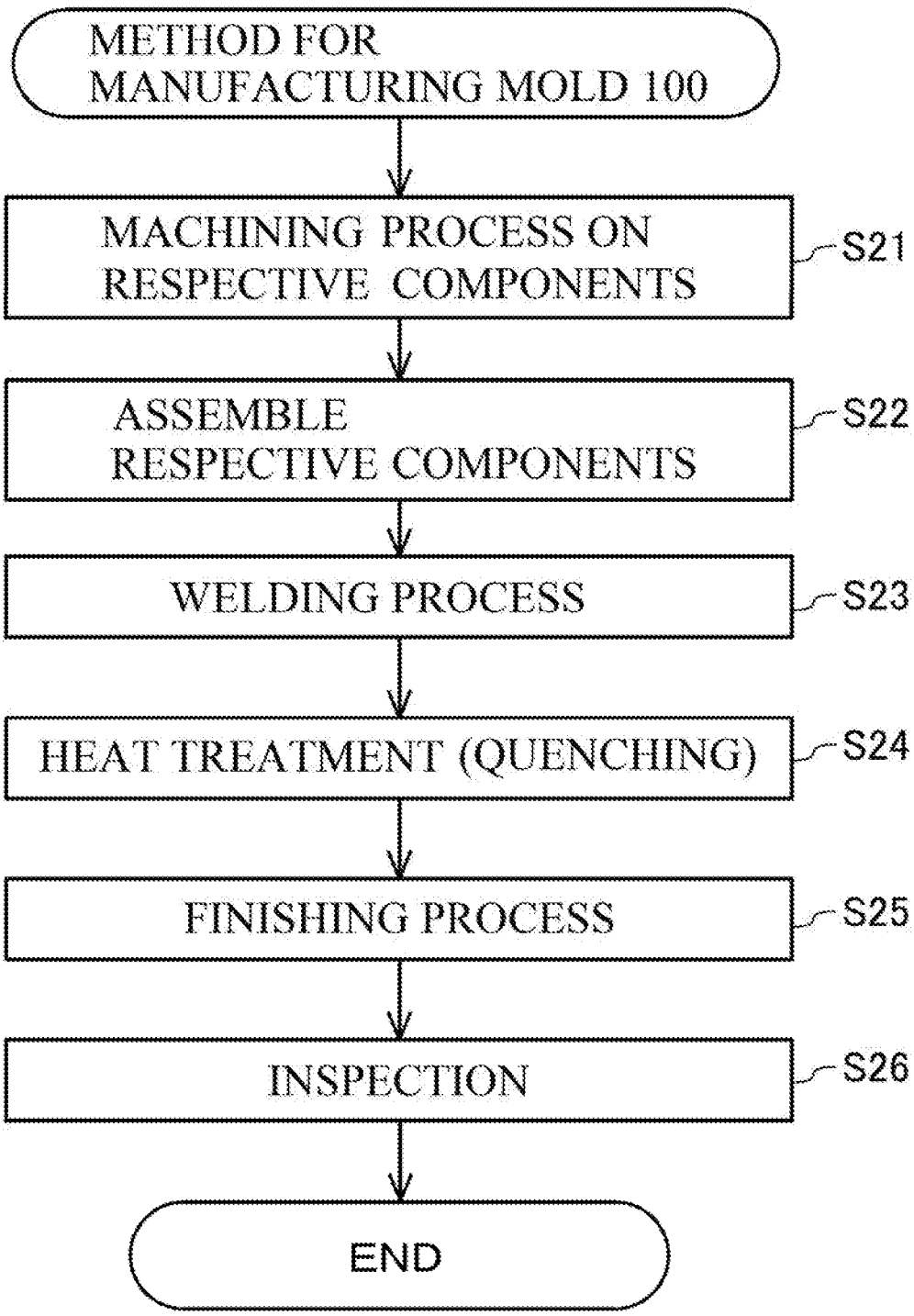
FIG. 4 is a flowchart illustrating a method for manufacturing the mold 100 according to the first embodiment.
Figure 5A:
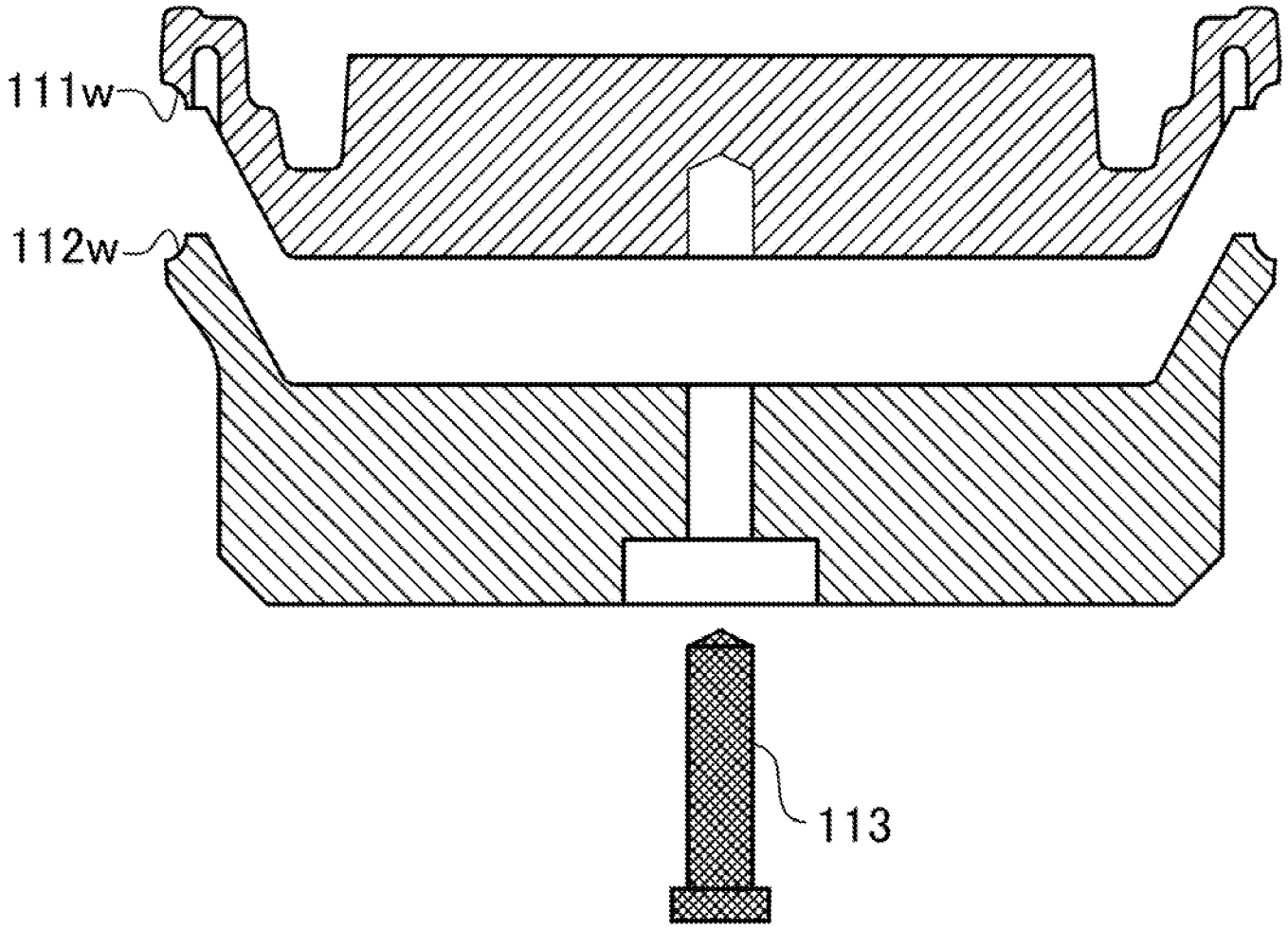
FIG. 5A is a process drawing illustrating the method for manufacturing the mold 100 according to the first embodiment.
Figure 5B:
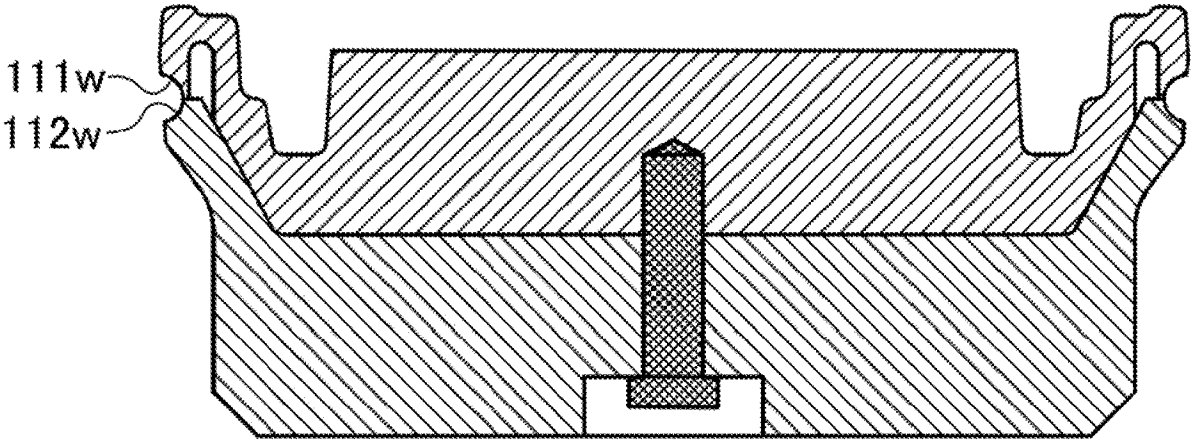
FIG. 5B is a process drawing illustrating the method for manufacturing the mold 100 according to the first embodiment.
Figure 5C:
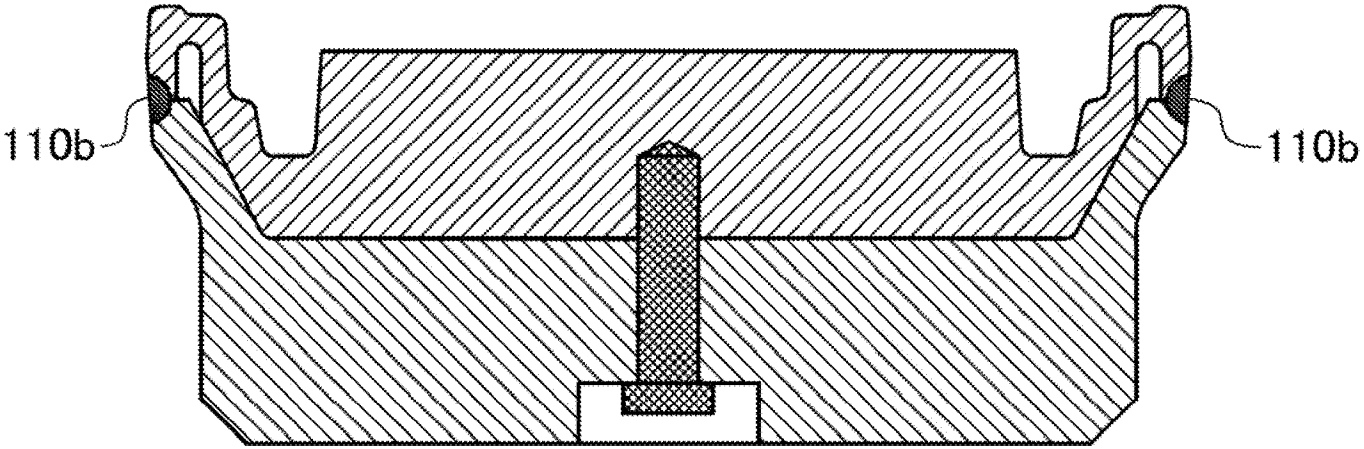
FIG. 5C is a process drawing illustrating the method for manufacturing the mold 100 according to the first embodiment.

FIG. 4 is a flowchart illustrating the method for manufacturing the mold 100 according to the first embodiment. FIG. 5A to FIG. 5C are process drawings illustrating the method for manufacturing the mold 100 according to the first embodiment. To achieve the above-described constitution, the mold 100 is manufactured by the following method. Step S21 performs the machining process on the respective components (see FIG. 5A). Especially, the respective components of the first part 111 and the second part 112, which constitute the insert die 110, are all manufactured by performing the machining process on materials, which is the SKD 61, before quenching.

On the outer periphery of the first part 111, depressed portions 111*w*, which have a depressed shape for build-up welding, are formed. On the outer periphery of the second part 112, depressed portions 112*w*, which have a depressed shape for build-up welding, are formed.

Step S22 assembles the respective components. Specifically, the first part 111 and the second part 112, which constitute the insert die 110, are combined. The combined first part 111 and second part 112 are fastened by the bolt 113. This forms the depressed portions 111*w* and 112*w* (see FIG. 5B) to form the weld beads 110*b* across the peripheral areas of the first part 111 and the second part 112. The depressed portions 111*w* and 112*w* have a semicircular cross section.

Step S23 performs the welding process. As described above, the welding process is performed by forming the weld bead 110*b* (see FIG. 1 and FIG. 5C) by the TIG welding using the TIG welding rod (for example, the DS-61G). The weld bead 110*b* is appropriately melted into both the first part 111 and the second part 112, thus constituting a gradient metal.

Note that the TIG welding rod (for example, the DS-61G) forms the weld-overlay portion by the deposited metal with the composition similar to the SKD 61, and different from the welding repair, the first part 111 and the second part 112 are in the state of before quenching. Accordingly, the weld bead 110*b* forms the gradient metal having extremely smooth gradient by including a heating process. Accordingly, the first part 111 and the second part 112 are combined and fastened by the bolt 113, thus manufacturing a welded half-finished product of the insert die 110.

Step S24 performs the heat treatment (the quenching) on the half-finished product of the insert die 110. By this process, the insert die 110 has sufficient toughness and rigidity. In this respect, the first part 111, the second part 112, and the weld bead 110*b* before quenching are all integratedly quenched. Therefore, the weld bead 110*b* has a physical property significantly similar to the first part 111 and the second part 112. Accordingly, a physical property boundary hardly occurs between the weld beads 110*b* and the first part 111 and the second part 112 as the base material, ensuring effectively minimizing the thermal fatigue generated caused by the boundary.

Step S25 performs a finishing process. The finishing process includes the machining process to form the outer shape of the weld bead 110*b* into a shape so as to fit the depressed portion 130*c* of the movable-side main mold 130. Furthermore, the finishing process includes the overall machining process of the outer surface and the surface treatment to achieve an appropriate fitting state between the insert die 110 on which thermal distortion is generated and the movable-side main mold 130. Furthermore, the finishing process includes the machining process and the surface treatment to achieve the appropriate fitting state between the fixed-side main mold 120, the movable-side main mold 130, and the insert die 110.

Step S26 inspects the mold 100. This inspection includes a pressure resistance inspection, an X-ray inspection, or a similar inspection on the cooling water passage 114. These processes allow manufacturing the mold 100 having the constitution of the first embodiment.

This manufacturing process starts manufacturing the respective components of all the first part 111 and the second part 112, which constitute the insert die 110, from the process of the machining process on the materials, which is the SKD 61, before quenching, and after welding and joining the first part 111 and the second part 112, the first part 111 and the second part 112 are integratedly quenched. Furthermore, the welding process forms the weld-overlay portion with the deposited metal with the composition similar to the SKD 61. Accordingly, the physical property boundary hardly occurs between the weld beads 110*b* and the first part 111 and the second part 112 as the base material. As a result, the thermal fatigue generated caused by the boundary can be effectively minimized.

D. Constitution of Casting Apparatus (Spool Bush) in Second Embodiment

Figure 6:
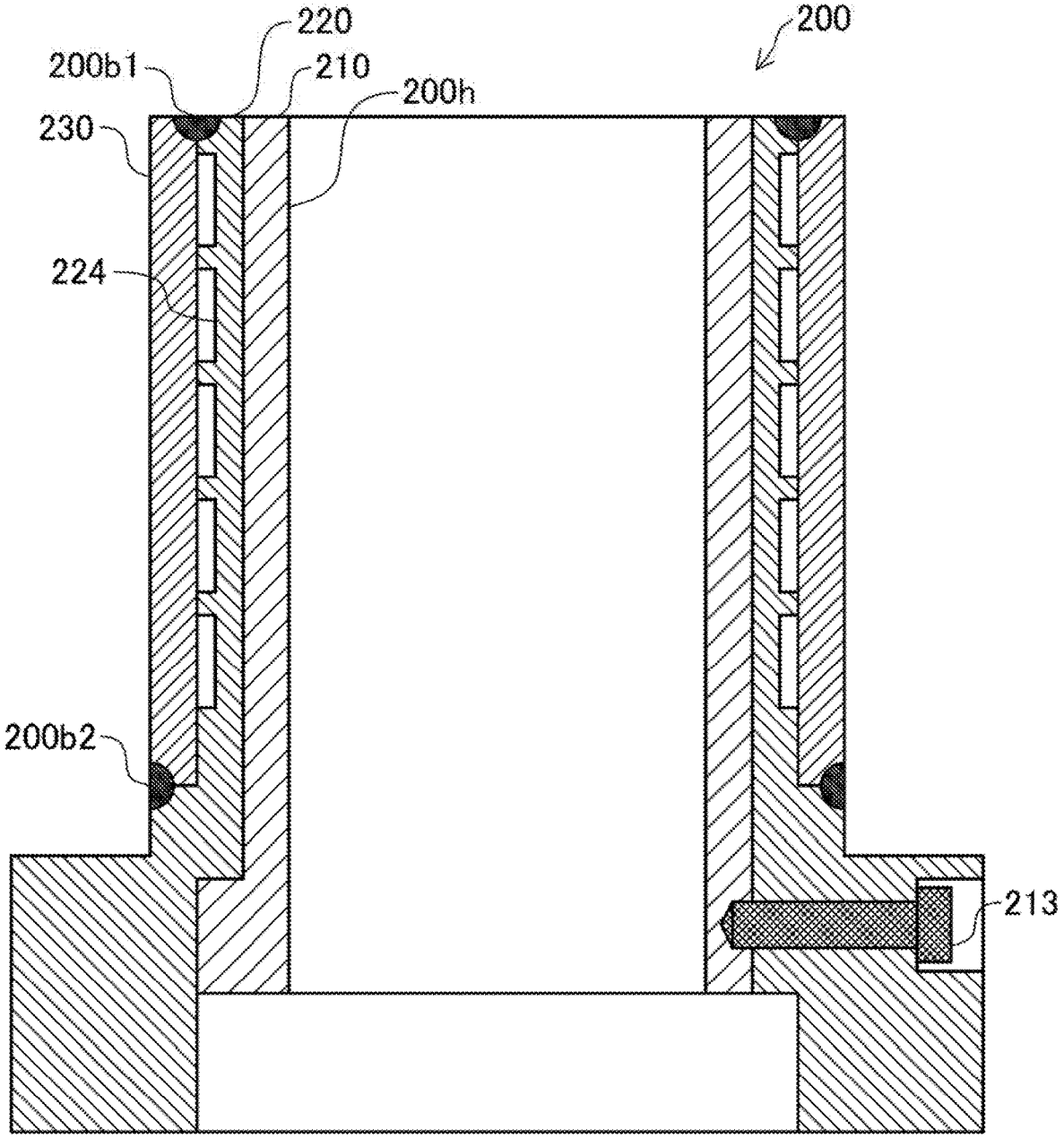
FIG. 6 is a cross-sectional view illustrating a constitution of a die-cast-casting-machine use spool bush 200 according a second embodiment.

FIG. 6 is an explanatory view illustrating the constitution of a die-cast-casting-machine use spool bush 200 (hereinafter simply referred to as a spool bush) according the second embodiment. The spool bush 200 is a component to cause the molten metal to pass through itself and to pour (supply) molten metal to the mold (for example, the mold 100). The spool bush 200 has its central axis in the vertical direction in the drawing and has a cylindrical shape including a hollow part. The spool bush 200 is the casting apparatus used for casting.

The spool bush 200 includes insertion liners 210, a bush body 220, outer liners 230, and a bolt 213. On the inner surfaces of the insertion liners 210, plunger holes 200*h* are formed. Through the plunger hole 200*h*, a plunger (not illustrated), which pushes the molten metal, passes. The insertion liner 210 is a replacement component. The inner surface of the plunger hole 200*h* is also referred to as the molten metal contacting surface.

The spool bush 200 is constituted as follows. The bolt 213 fastens the insertion liner 210 and the bush body 220. The outer liner 230 and the bush body 220 are permanently fastened with two weld beads 200*b*1 and 200*b*2 (also referred to as welding portions). The two weld beads 200*b*1 and 200*b*2 are each formed into a ring shape around the central axis of the spool bush 200.

The spool bush 200 includes cooling water passages 224 (which corresponds to the cooling portion in the appended claims). The cooling water passage 224 is formed of the inner surface of the outer liner 230 and a cooling groove 220*g* (see FIG. 8). The cooling groove 220*g* is formed on the outer diameter surface of the bush body 220. The cooling water passages 224 are each formed into the ring shape around the central axis of the spool bush 200 and partially communicate with one another in the central axis direction of the spool bush 200. In the cooling water passage 224, the cooling water inlet (not illustrated) communicates with the cooling water discharge port (not illustrated). Accordingly, the cooling water passage 224 is constituted as a circulation path. This quickly solidifies a molten metal, allowing shortening the cycle time of casting.

The spool bush 200 is constituted such that the two weld beads 200*b*1 and 200*b*2 are not exposed to the molten metal during the operation. Thus, the two weld beads 200*b*1 and 200*b*2 are not exposed to the molten metal. This allows preventing a heat cycle, which is caused by the two weld beads 200*b*1 and 200*b*2 in contact with the molten metal.

E. Method for Manufacturing Spool Bush in Second Embodiment

Figure 7:
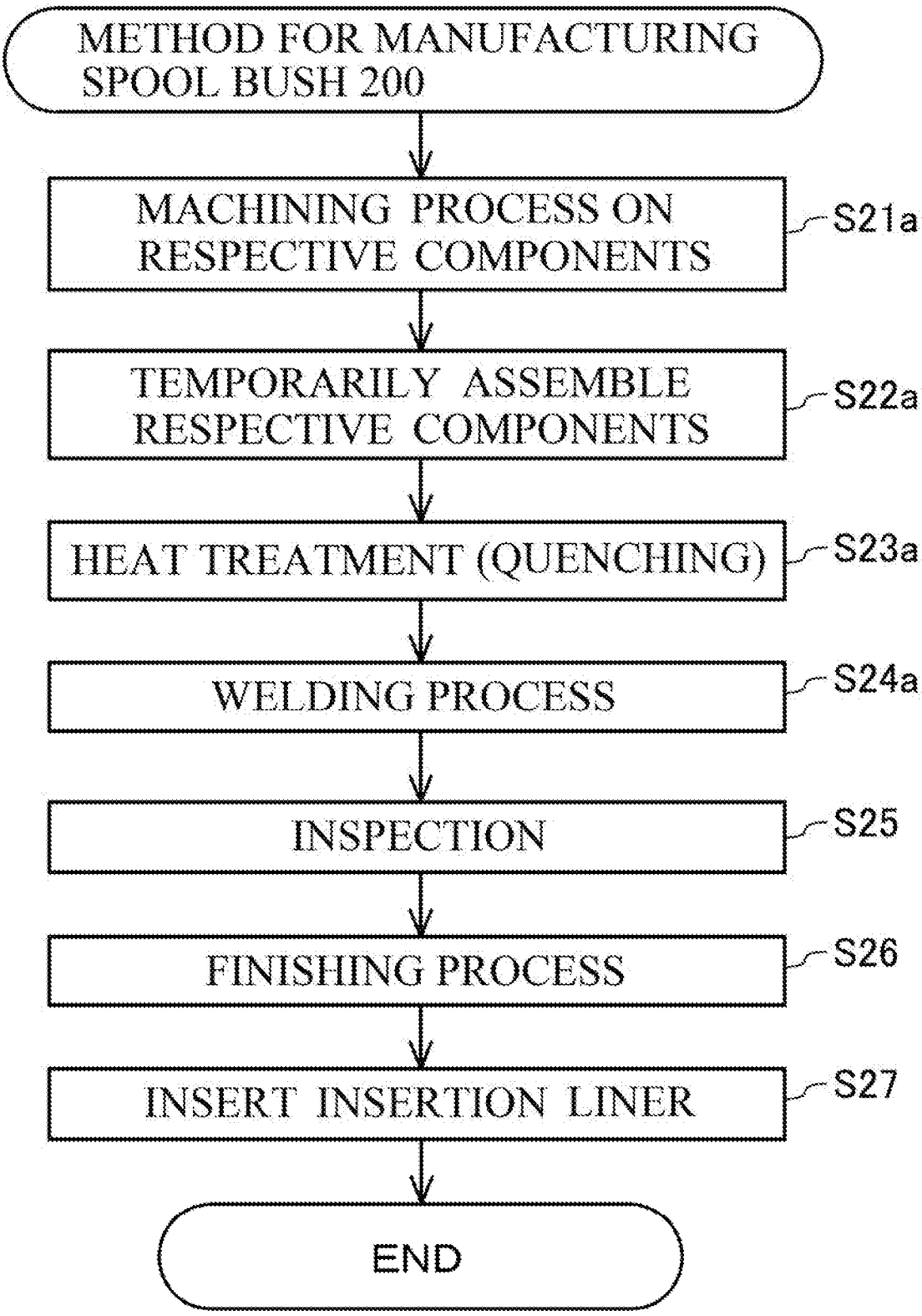
FIG. 7 is a flowchart illustrating a method for manufacturing the spool bush 200 according to the second embodiment.
Figure 8:
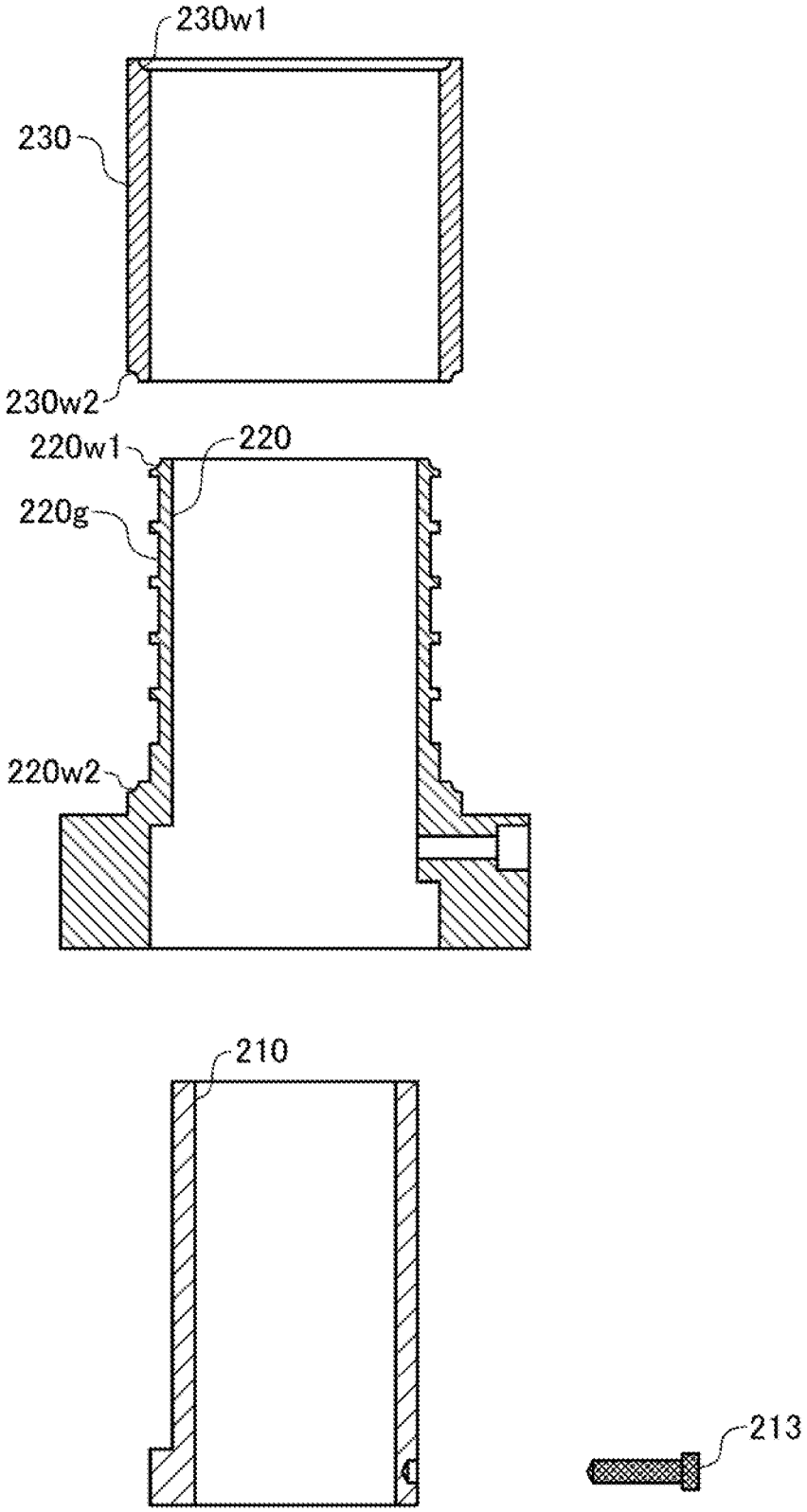
FIG. 8 is an exploded view illustrating the method for manufacturing the spool bush 200 according to the second embodiment.
Figure 9:
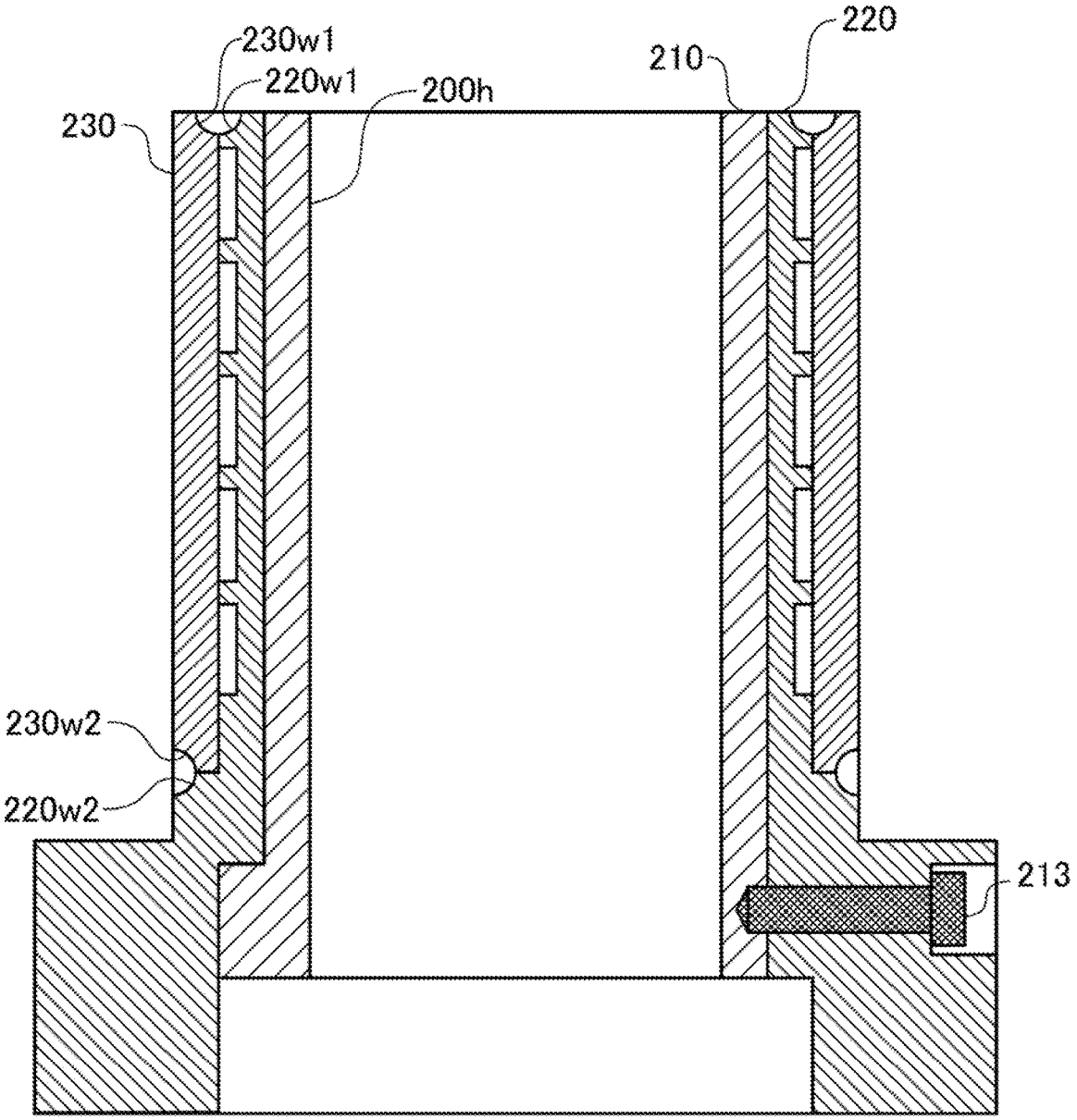
FIG. 9 is a process drawing illustrating an assembled state (before welding) of a bush body 220 and an outer liner 230 according to the second embodiment.

FIG. 7 is a flowchart illustrating a method for manufacturing the spool bush 200 according to the second embodiment. FIG. 8 is a process drawing illustrating the method for manufacturing the spool bush 200 according to the second embodiment. FIG. 9 is a process drawing illustrating an assembled state (before welding) of the bush body 220 and the outer liners 230 according to the second embodiment. To achieve the above-described constitution, the spool bush 200 is manufactured by the following method. Step S21*a* performs the machining process of the bush body 220 and the outer liners 230 (see FIG. 8). Similar to the first embodiment, these respective components are all manufactured by performing the machining process on materials, which is the SKD 61, before quenching.

On the inner periphery at the upper end and on the outer periphery at the lower end of the outer liner 230, a depressed portion 230*w*1 and a depressed portion 230*w*2, which have a depressed shape for build-up welding, are formed, respectively. On the outer periphery at the upper end and on the inner periphery at the lower end of the bush body 220, a depressed portion 220*w*1 and a depressed portion 220*w*2, which have a depressed shape for build-up welding, are formed, respectively (see FIG. 9).

Step S22*a* temporarily assembles the respective components 220 and 230. Specifically, Step S22*a* combines the bush body 220 and the outer liners 230. In this respect, the depressed portions 220*w*1 and 230*w*1 to form the weld beads 200*b*1 (also referred to as the welding portions or the weld-overlay portions) are formed across the upper ends of the bush body 220 and the outer liners 230. The depressed portions 220*w*1 and 230*w*1 have a semicircular cross section. Furthermore, the depressed portions 220*w*2 and 230*w*2 to form the weld beads 200*b*2 are formed across the lower portion of the bush body 220 and the lower end of the outer liner 230. The depressed portions 220*w*2 and 230*w*2 have a semicircular cross section.

Step S23*a* performs the heat treatment (the quenching) on the respective components 220 and 230. This embodiment performs the heat treatment before the welding process in a state where the respective components 220 and 230 are disassembled. This is because that, regarding the shapes of the respective components 220 and 230, performing the heat treatment with the respective components 220 and 230 combined results in excessive internal stress, which is generated by the heat treatment.

Step S24*a* performs the welding process. Note that a finish machining process is performed before the welding process to assemble the respective components 220 and 230. This does not cause excessive internal stress after the heat treatment (in the form of a product). As described above, the welding process is performed by forming the weld beads 200*b*1 and 200*b*2 (see FIG. 6) by the TIG welding using the TIG welding rod (for example, the DS-61G). The weld beads 200*b*1 and 200*b*2 are appropriately melted into both the bush body 220 and the outer liner 230, thus constituting a gradient metal. This manufactures the half-finished product of the spool bush 200.

Similar to the first embodiment, Step S25 performs the finishing process. The finishing process includes the machining process. The machining process forms the inner surface shape of the bush body 220 into a shape so as to fit the outer surface shape of the insertion liner 210, which is the replacement component. Similar to the first embodiment, Step S26 inspects the mold 100. Step S27 inserts the insertion liner 210 to the inside of the bush body 220, and the bolt 213 fastens both.

This manufacturing process forms the weld-overlay portions at all the respective components of the bush body 220 and the outer liner 230 with the deposited metal with the composition similar to the SKD 61. This ensures effectively minimizing the thermal fatigue.

The die-cast-casting-machine use spool bush 200 of the second embodiment uses the cooling water passages 224 to quickly solidify the molten metal, thus ensuring shortening the cycle time for casting. Furthermore, without the use of an O-ring or a similar component, the weld beads 200*b*1 and 200*b*2 where thermal fatigue is effectively minimized can constitute the cooling water passages 224. This allows enhancing the durability of the spool bush 200.

F. Constitution of Casting Apparatus (Mold) in Third Embodiment

Figure 10A:
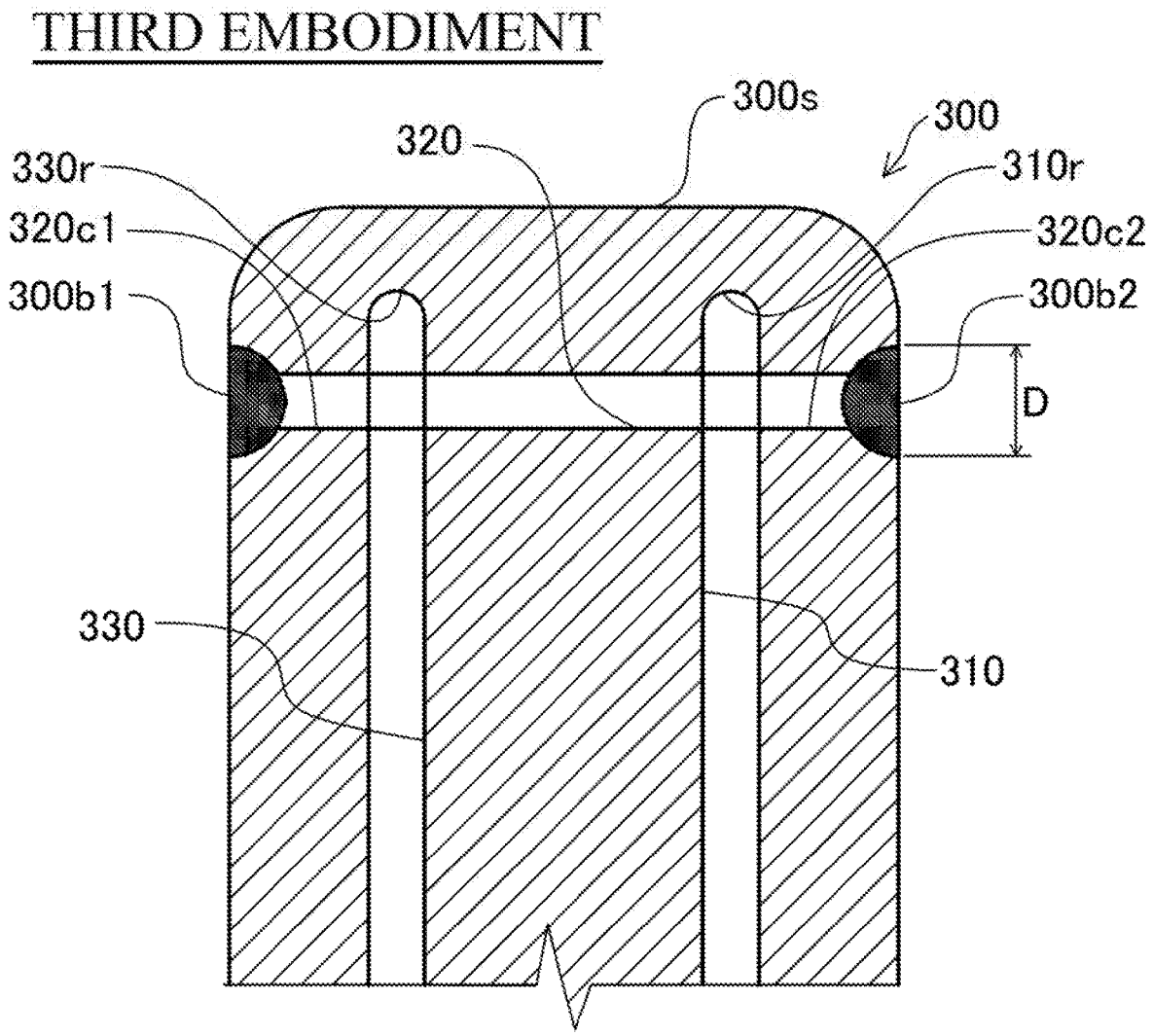
FIG. 10A is a cross-sectional view illustrating a part of a constitution of a mold 300 according to a third embodiment.

FIG. 10A is a cross-sectional view illustrating a part of a constitution of a mold 300 according to the third embodiment. The mold 300 has convex portions (illustrated) and internally has cooling flow passages 310, 320, and 330 (which corresponds to the cooling portion in the appended claims). The two linear cooling flow passages 310 and 330 extend parallel toward the proximity of a product shape forming surface 300*s* of the mold 300. On the other hand, the linear cooling flow passage 320 communicates with both the two cooling flow passages 310 and 330. Accordingly, the three linear cooling flow passages 310, 320, and 330 are mutually communicated and form a circulation path. The product shape forming surface 300*s* is also referred to as the molten metal contacting surface.

The cooling flow passage 320 is sealed by weld beads 300*b*1 and 300*b*2 at both ends. This forms columnar flow passages 320*c*1 and 300*c*2 at respective both ends of the cooling flow passage 320. The one end of the columnar flow passage 320*c*1 is sealed by the weld bead 300*b*1 and the other end is coupled to the circulation path. On the other hand, the one end of a columnar flow passage 320*c*2 is sealed by the weld bead 300*b*2 and the other end is coupled to the circulation path.

The weld beads 300*b*1 and 300*b*2 seal the one ends of both the columnar flow passages 320*c*1 and 300*c*2. Therefore, according to the usual viewpoint of hydromechanics, this structure forms a stagnation; therefore, cooling cannot be expected. However, according to analysis of the inventor of this application, the following has been found. Since the cooling water spouts and flows in at constant cycles by evaporation (in another technical field, this has been known as a so-called pop pop boat principle), this structure features high cooling capacity contrary to common sense.

G. Method for Manufacturing Mold in Third Embodiment

Figure 10B:
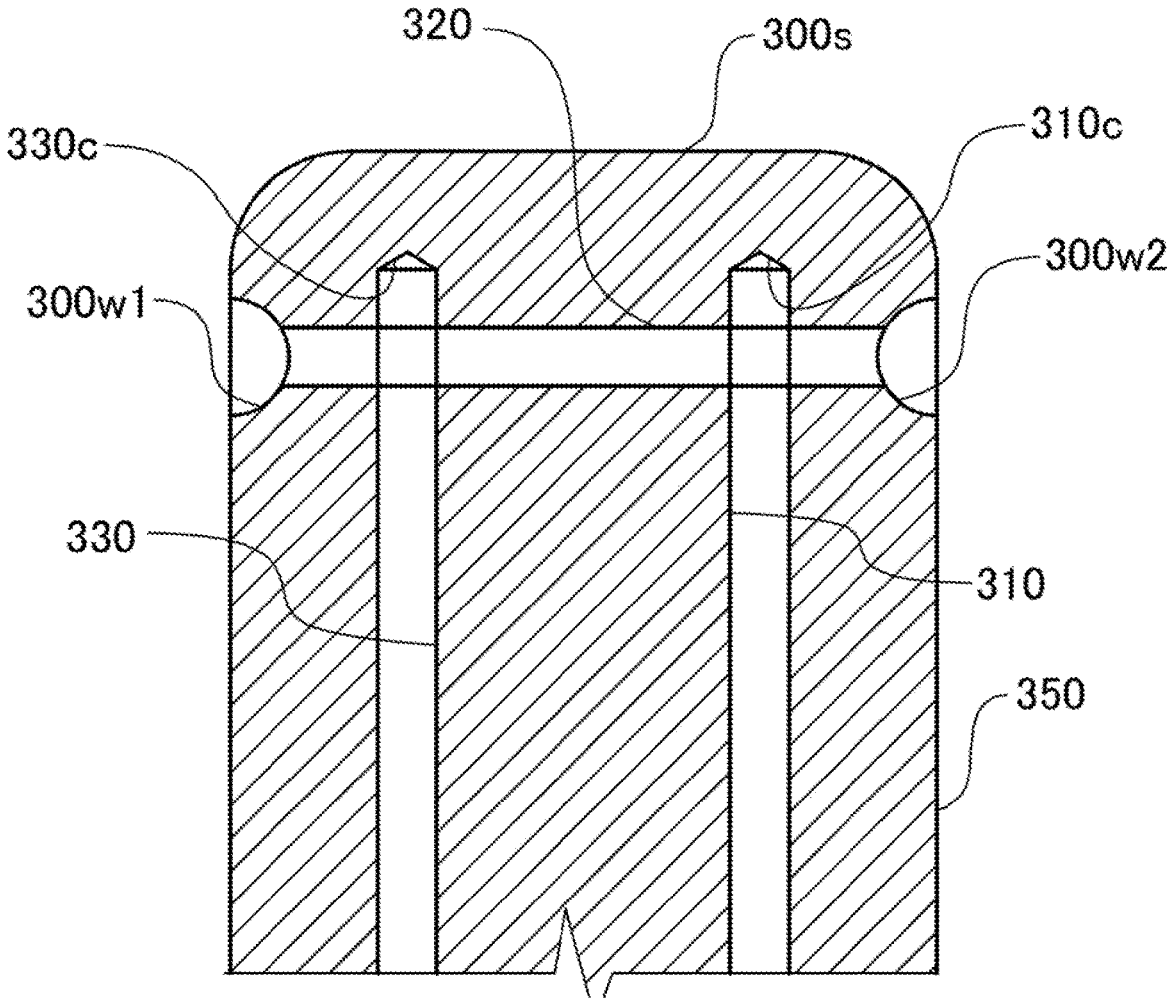
FIG. 10B is a process drawing illustrating a state after a machining process (before welding) of the mold 300 according to the third embodiment.
Figure 11:
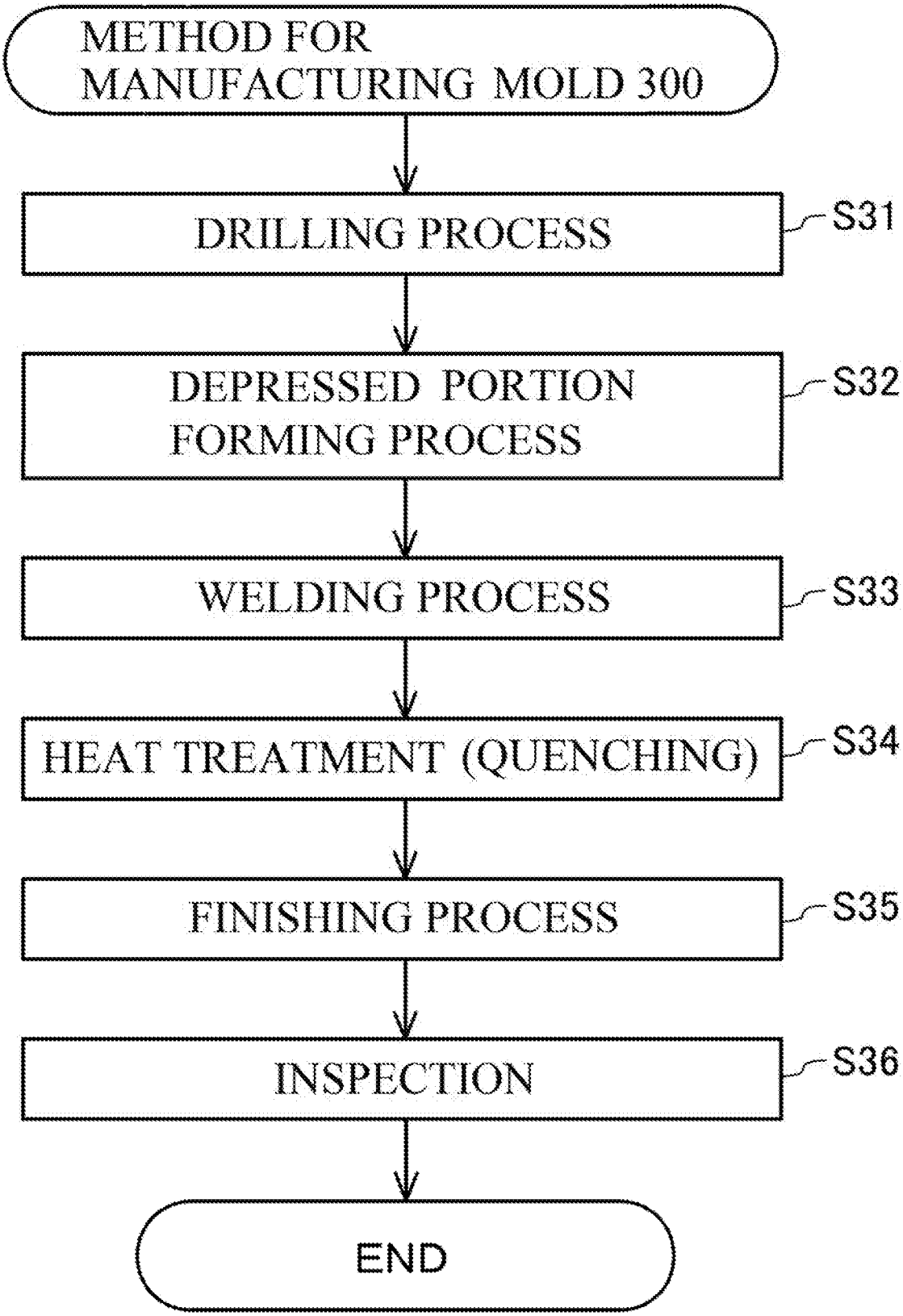
FIG. 11 is a flowchart illustrating the method for manufacturing the mold 300 according to the third embodiment.

FIG. 10B is a process drawing illustrating a state after a machining process (before welding) of the mold 300 according to the third embodiment. FIG. 11 is a flowchart illustrating the method for manufacturing the mold 300 according to the third embodiment. To achieve the above-described constitution, the mold 300 is manufactured by the following method.

Step S31 performs a drilling process (see FIG. 10B). In this embodiment, performing the machining process on a mold base metal 350 before quenching the SKD 61 manufactures the mold 300. A drill with a diameter of 6 mm forms three holes. The three holes include holes 310 and 330 and one through-hole 320. The two holes 310 and 330 are dug toward the product shape forming surface 300*s* up to the proximity of the product shape forming surface 300*s*. This constitution allows forming the circulation path inside the mold 300.

The drilling process includes a boring process and a rounding process. The boring process forms the holes 310 and 330 with a drill for boring (not illustrated). The rounding process rounds most depressed portions 310*c* and 330*c* (see FIG. 10B) of the bored holes to form rounded most depressed portions 310*r* and 330*r* (see FIG. 10A). The rounding process uses a dedicated tool whose distal end is rounded. The rounding process is performed to enhance the durability.

Step S32 performs a depressed portion forming process. The depressed portion forming process forms depressed portions 300*w*1 and 300*w*2 for build-up welding at both the end portions of the through-hole 320. The depressed portions 300*w*1 and 300*w*2 (see FIG. 10B) are formed into hemispherical depressed portions (see FIG. 10A) such that each diameter D of the weld beads 300*b*1 and 300*b*2 for build-up welding (also referred to as the welding portions or the weld-overlay portions) becomes twice as large as the hole diameter, which is 12 mm in this embodiment.

According to the analysis of the inventor of this application, the larger the diameter D is, the larger the pressure resistance of the cooling flow passage while reduction in durability caused by welding becomes remarkable. Contrary, the smaller the diameter D is, the lower the pressure resistance of the cooling flow passage while the reduction in the durability caused by welding becomes small. Therefore, the diameters D of the weld beads 300*b*1 and 300*b*2 are the most preferable to be 1.5 times to twice the hole diameter viewed from the axial directions of the columnar flow passages 320*c*1 and 300*c*2, and are also preferable to be 1 time to 2.5 times of the hole diameter.

Note that the embodiment can be achieved even outside the range. From the aspect of durability, the weld beads 300*b*1 and 300*b*2 can achieve sufficient cooling as long as the exposure to the molten metal is constituted so as to be equal to or less than a predetermined ratio with respect to areas of the weld beads 300*b*1 and 300*b*2, which constitute the inner surfaces of the columnar flow passages 320*c*1 and 300*c*2. The predetermined ratio can be determined according to the operating form (the temperature of molten metal and the shape of the mold).

Step S33 performs the welding process. As described above, the welding process is performed by forming the weld beads 300*b*1 and 300*b*2 by the TIG welding using the TIG welding rod (for example, the DS-61G). The weld beads 300*b*1 and 300*b*2 are appropriately melted into the mold base metal 350, thus constituting a gradient metal. Thus, the half-finished product of the mold 300 is manufactured.

Step S34 performs the heat treatment (the quenching) of the half-finished product of the mold 300. With this embodiment as well, a physical property boundary hardly occurs between the weld beads 300*b*1 and 300*b*2 and the mold base metal 350, ensuring effectively minimizing the thermal fatigue, which is generated caused by the boundary.

Step S35 performs the finishing process. Step S36 inspects the mold 300. This inspection includes the pressure resistance inspection, the X-ray inspection, or a similar inspection on the cooling flow passages 310, 320, and 330. These processes can manufacture the mold 300 having the constitution of the third embodiment.

According to this manufacturing process, similar to the first embodiment and the second embodiment, the physical property boundary hardly occurs between the weld beads 300*b*1 and 300*b*2 and the mold base metal 350. Furthermore, since the cooling water spouts and flows in at constant cycles in the columnar flow passages 320*c*1 and 300*c*2 by evaporation, the weld beads 300*b*1 and 300*b*2 can be effectively cooled. Additionally, it is constituted such that the exposure of the weld beads 300*b*1 and 300*b*2 to the molten metal becomes equal to or less than the predetermined ratio with respect to the areas of the weld beads 300*b*1 and 300*b*2, which constitute the inner surfaces of the columnar flow passages 320*c*1 and 300*c*2, to ensure sufficiently cooling. As a result, the thermal fatigue generated caused by the boundary with the weld beads 300*b*1 and 300*b*2 can be effectively minimized.

H. Modification

In the above-described embodiment, this build-up welding is formed by the TIG welding using the TIG welding rod; however, another welding method may be employed. Note that since the TIG welding can obtain beautiful, high-quality weld beads (weld-overlay portions) and therefore is preferable in terms of allowing application to welding of various metals.

The casting apparatus may be constituted as follows. The casting apparatus has a plurality of components including a welding component having the welding portion. With the plurality of components assembled, the welding portion is constituted not to be exposed to the molten metal.

The casting apparatus may be constituted as follows. The casting apparatus is a mold. The molten metal contacting surface constitutes a part of the mold as a product shape forming surface. The product shape forming surface forms a shape of the cast product set in advance. An outer surface of the welding portion is constituted so as not to be exposed to the molten metal by contact with any of outer surfaces of the plurality of components.

The casting apparatus may be constituted as follows. The cooling portion is manufactured by welding a material before quenching and subsequently quenching the material.

The casting apparatus may be constituted as follows. The casting apparatus is a mold. The cooling flow passage includes a columnar flow passage. One end of the columnar flow passage is sealed by the welding portion. Another end of the columnar flow passage communicates with a circulation path. The circulation path causes a cooling medium to circulate. The welding portion has a diameter 1.5 times to 2.5 times of a diameter of the columnar flow passage viewed from an axial direction of the columnar flow passage such that the diameter becomes equal to or less than the predetermined ratio.

The casting apparatus may be constituted as follows. A length of the columnar flow passage from the one end to the other end is longer than the diameter of the columnar flow passage.

The casting apparatus may be constituted as follows. The casting apparatus is a sprue bushing. The molten metal contacting surface constitutes a path to cause the molten metal to pass through to supply the molten metal to the mold.

The casting apparatus may be constituted as follows. The columnar flow passage is a mold whose length from the one end to the other end is longer than the diameter of the columnar flow passage.

While one or more embodiments of the present invention seals the cooling flow passage by the welding process, the reduction in durability of the casting apparatus caused by the welding process can be minimized.

What is claimed is:

1. A method of producing an insert die of a casting apparatus for manufacturing a cast product from molten metal, wherein the casting apparatus comprises a fixed-side main mold and a movable-side main mold that has a depressed portion, the method comprising:

providing a first part before quenching having a molten metal contacting surface for contact with the molten metal and an annular depressed portion;

providing a second part before quenching having an outer surface to be fitted to the depressed portion;

providing a bolt for fastening the first part and the second part together;

combining and fastening the first part and the second part together by the bolt, and covering an opening of the annular depressed portion by the second part, so as to form a cooling flow passage;

forming a welding portion that welds the first part and the second part, so as to seal the cooling flow passage from outside of the cooling flow passage;

quenching the welded first and second parts integratedly; and finishing, after the quenching, such that an outer surface of the welding portion comes into contact with an inner surface of the depressed portion.

2. A casting apparatus for manufacturing a cast product from molten metal, the casting apparatus comprising:

a fixed-side main mold;

a movable-side main mold comprising a depressed portion; and an insert die comprising a molten metal contacting surface for contact with the molten metal, a cooling portion forming a cooling flow passage that cools the molten metal contacting surface, and a welding portion that seals the cooling flow passage from outside of the cooling flow passage, wherein the insert die is produced by the method according to claim 1.

3. The casting apparatus according to claim 2, wherein:

a protrusion is formed at the molten metal contacting surface;

an annular depressed portion is formed at an inside of the protrusion;

the second part of the insert die covers an opening of the annular depressed portion, so as to form the cooling flow passage; and the welding portion welds the first part and the second part, so as to seal the cooling flow passage from the outside of the cooling flow passage.

4. The casting apparatus according to claim 3, wherein the insert die further comprises a bolt that fastens the first and second parts together, and the cooling flow passage has an annular shape viewed from an axial direction of the bolt.

5. The casting apparatus according to claim 2, wherein each of the first part and the second part is made of a tool steel, and the welding portion is made of deposited metal.

6. The casting apparatus according to claim 5, wherein:

each of the first part and the second part is made of an SKD 61; and the deposited metal, of which the welding portion is made, is formed by TIG welding using a TIG welding rod.

7. The casting apparatus according to claim 6, wherein the TIG welding rod is a DS-61G.

* * * * *